US007637681B2

(12) United States Patent
Lin

(10) Patent No.: US 7,637,681 B2
(45) Date of Patent: Dec. 29, 2009

(54) WRITING IMPLEMENT AND CHOPSTICK COMBINATION

(76) Inventor: Hui-Feng Lin, No. 261, Sec. 5, Hewei Rd., Tainan City (TW)

( * ) Notice: Subject to any disclaimer, the term of this patent is extended or adjusted under 35 U.S.C. 154(b) by 9 days.

(21) Appl. No.: 12/216,652

(22) Filed: Jul. 9, 2008

(65) Prior Publication Data

US 2009/0226239 A1 Sep. 10, 2009

(30) Foreign Application Priority Data

Mar. 7, 2008 (TW) ..... 97203966 U

(51) Int. Cl.
*B43K 29/00* (2006.01)

(52) U.S. Cl. ..... 401/195

(58) Field of Classification Search ..... 401/16–21, 401/25, 27, 195; 294/1.1, 5.5; 30/164.7; 7/160

See application file for complete search history.

(56) References Cited

U.S. PATENT DOCUMENTS 1,427,711 A * 8/1922 Bartle et al. ..... 401/187
3,234,916 A * 2/1966 Fassbender ..... 401/116
D204,449 S * 4/1966 Zavodsky ..... D4/121
4,440,161 A * 4/1984 Wadhwa ..... 128/202.13

* cited by examiner

*Primary Examiner*—David J. Walczak
*Assistant Examiner*—Ryan A Varnum
(74) *Attorney, Agent, or Firm*—Rosenberg, Klein & Lee

(57) ABSTRACT

A writing implement core is positioned in a tube, which has first and second step-shaped ends with threads; a head sleeve is threadedly joined on the second end of the tube with the writing core sticking out therefrom; a shell is threadedly joined on one of the ends of the tube, and can be reloacted relative to the tube to adapt the writing implement for use as a chopstick; a cap is provided, which can be positioned around the tube to cover the writing core; a chopstick member is threadedly joined on the first end of the tube; when the shell is joined on the first end of the tube, it will cover the chopstick member, and the writing implement and chopstick combination can be used as a writing implement; the combination can be used as a chopstick after the shell is relocated on the second end of the tube.

12 Claims, 12 Drawing Sheets

WRITING IMPLEMENT AND CHOPSTICK COMBINATION

BACKGROUND OF THE INVENTION

1. Field of the Invention

The present invention relates to a writing implement and chopstick combination, more particularly one, which allows the writing cores of a wide variety of writing implements to be installed therein, and can be easily adapted to serve as either a chopstick or a writing implement.

2. Brief Description of the Prior Art

Disposable chopsticks are usually made of bamboo materials, which are not only dirty but also toxic, and prone to have moulds of various colors thereon. Therefore, disposable bamboo chopsticks are usually processed to get rid of moulds and become pleasant-looking with preservatives and bleaching agents in manufacturing, which usually contain relatively much carcinogenic chemical, and whose concentration is usually thousands of times the stipulated maximum limit. Many people have changed from such disposable bamboo chopsticks to environmentally friendly chopsticks, which can be easily contracted, and are portable, and can be used many times so as not to harm the environment.

A common environmentally friendly chopstick includes an upper chopstick part, and a lower chopstick part. The upper chopstick part has a screw hole in a lower portion while the lower chopstick part has a threaded post protruding from an upper end, and a colored ring around the threaded post; the upper and the lower chopstick parts are joined together for use with the threaded post being threadedly joined in the threaded hole. Another chopstick includes an upper chopstick part, and a lower chopstick part. The upper chopstick part has a middle holding room, annular grooves on an inner side of the middle holding room, and through holes near the lower end. The lower chopstick part has an insertion portion at an upper end, which has cavities and a through hole thereon. And, beads, springs, and fixing pieces are held in the cavities of the insertion portion of the lower chopstick part. Furthermore, the upper part has a fastening piece joined on an outer side thereof therefore the chopstick can be fastened on a pocket.

The above chopsticks are easily portable, contractible, and hygienic, and therefore are very popular as a substitute for disposable bamboo chopsticks. However, the users can easily forget to carry the chopsticks when going out because the chopsticks have single function, and won't be used except for dining.

Therefore, it is a main object of the present invention to provide a writing implement and chopstick combination, which can provide more convenience than the above-mentioned chopsticks, and can't be as easily forgettable as the above chopsticks.

SUMMARY OF THE INVENTION

A writing implement and chopstick combination according to an embodiment of the present invention includes a tube, a writing core in the tube, and a chopstick member. The tube has first and second step-shaped ends with threads. A head sleeve is threadedly joined on the second end of the tube with the writing core sticking out therefrom. A shell is threadedly joined on one of the ends of the tube, and can be reloacted relative to the tube to adapt the combination for use as a chopstick. A cap is provided, which can be positioned around the tube to cover the writing core. The chopstick member is threadedly joined on the first end of the tube; when the shell is joined on the first end of the tube, it will cover the chopstick member, and the combination can be used as a writing implement; the combination can be used as a chopstick after the shell is relocated on the second end of the tube. Furthermore, the writing core can be one of a water ink-containing writing implement, a ball-point pen, an eyebrow pencil, a pencil, a marker with luminous ink, a lip brush or a lipstick.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
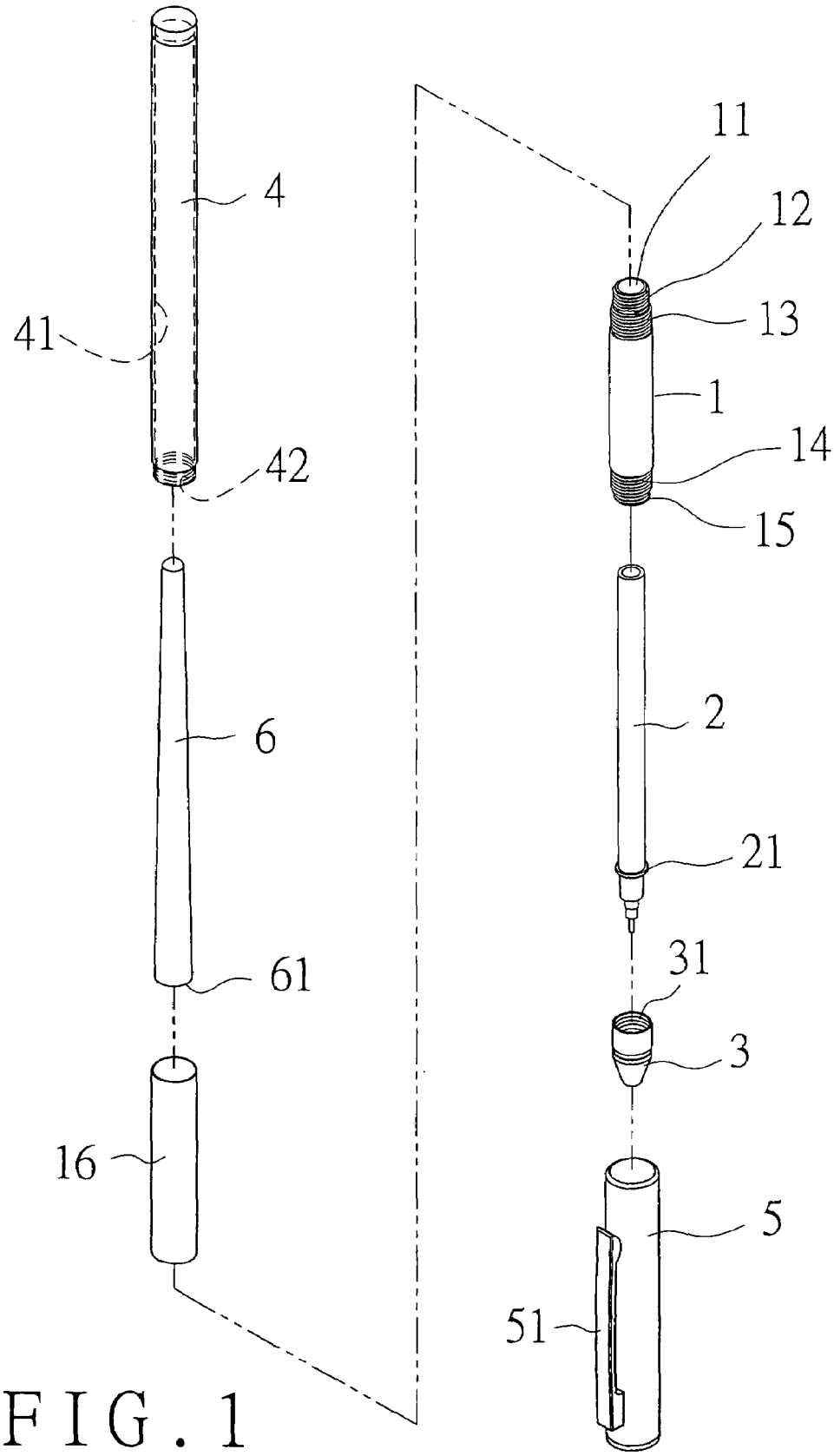
FIG. 1 is an exploded perspective view of a first preferred embodiment of the present invention.
Figure 9:
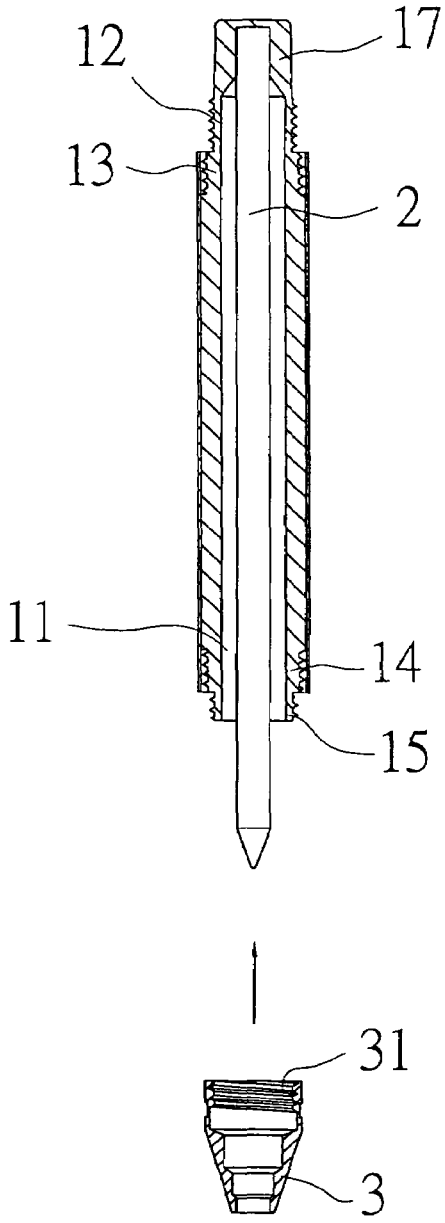
FIG. 9 is a sectional view, taken when the second embodiment is being adapted (1)
Figure 2:
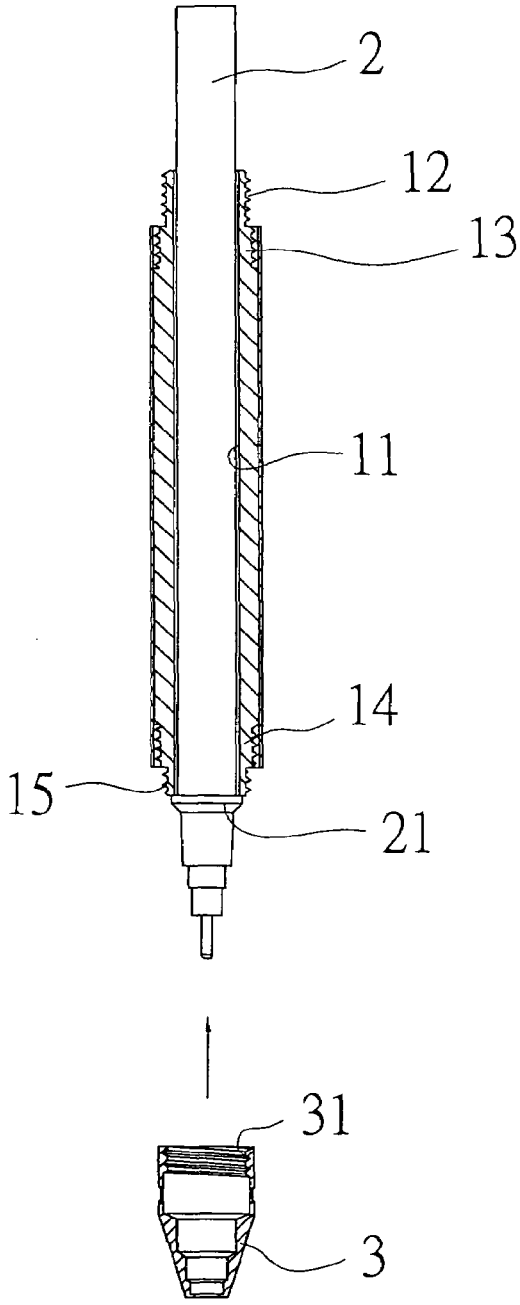
FIG. 2 is a sectional view, taken when the first embodiment is being adapted (1)
Figure 3:
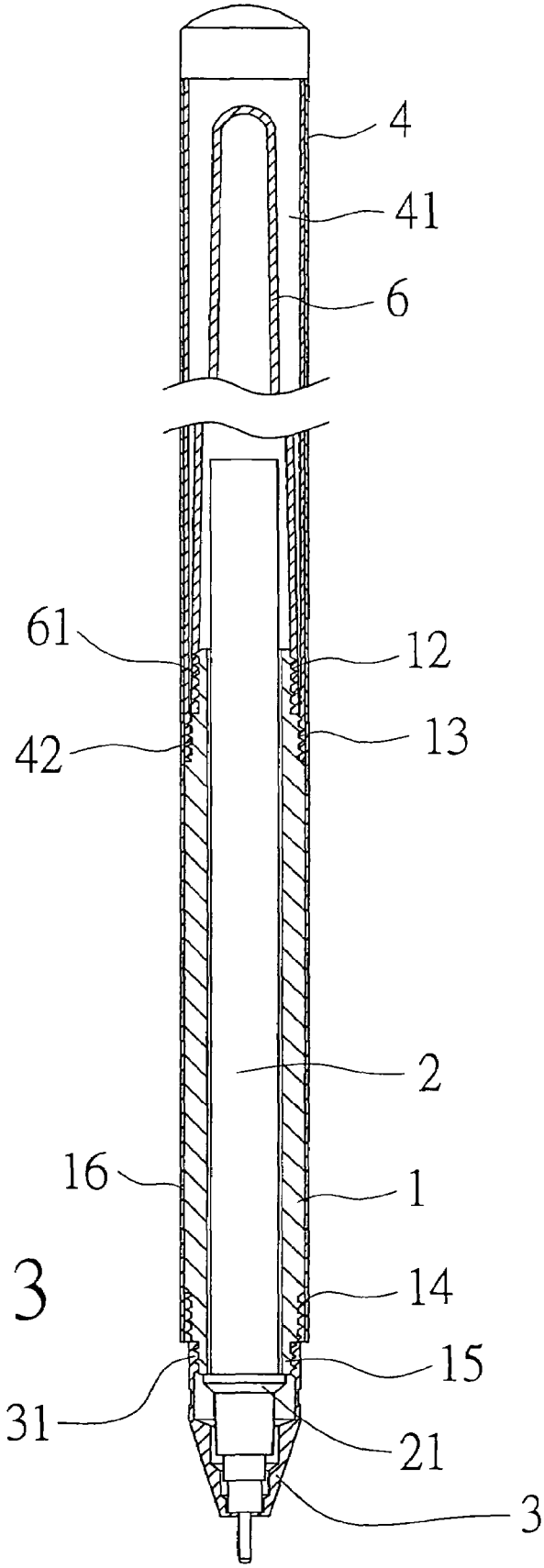
FIG. 3 is a sectional view, taken when the first embodiment is being adapted (2)

Referring to FIG. 1 to FIG. 3, a first preferred embodiment of a writing implement and chopstick combination of the present invention includes:

a writing implement tube 1, which has a middle hollowness 11, and has a first and second step-shaped ends; the first step-shaped end includes first and second threaded portions 12 and 13 while the second step-shaped end includes third and fourth threaded portions 14 and 15; the writing implement tube 1 has a middle circumferential portion 16, which sticks farther away from an axis of the writing implement tube 1 than the second and the third threaded portions 13 and 14;

a writing core 2 passed through the middle hollowness 11 of the writing implement tube 1; the writing core 2 contains water ink, and has a stopping rim 21 on a front end thereof;

a writing implement head sleeve 3, which is joined on the fourth threaded portion 15 of the writing implement tube 1 with the writing core 2 sticking out therefrom; the writing implement head sleeve 3 has a threaded portion 31 on an inner side to threadedly engage the fourth threaded portion 15 of the writing implement tube 1;

a writing implement shell 4; the writing implement shell 4 has a hollow holding room 41, and a threaded portion 42 on an inner side of an open end thereof to threadedly engage either the second threaded portion 13 or the third threaded portion 14 of the writing implement tube 1; the writing implement shell can be repositioned relative to the writing implement tube 1 to adapt the present writing implement and chopstick combination for use;

a writing implement cap 5 to be positioned around the middle circumferential portion 16 of the writing implement tube 1; the cap 5 has a fastening piece 51 thereon; and a chopstick member 6 joined on the first end of the writing implement tube 1; the chopstick part 6 has a threaded portion 61 on an inner side of one end thereof, which threadedly engages the first threaded portion 12 of the writing implement tube 1.

Figure 4:
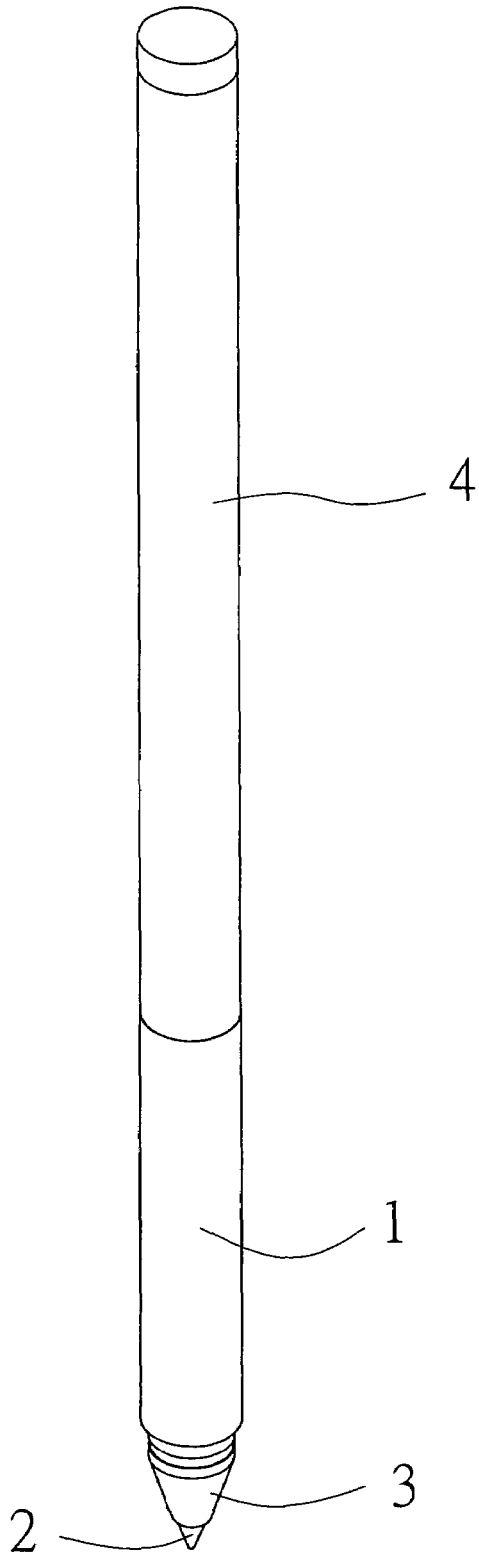
FIG. 4 is a view of the first embodiment being used as a writing implement.
Figure 5:
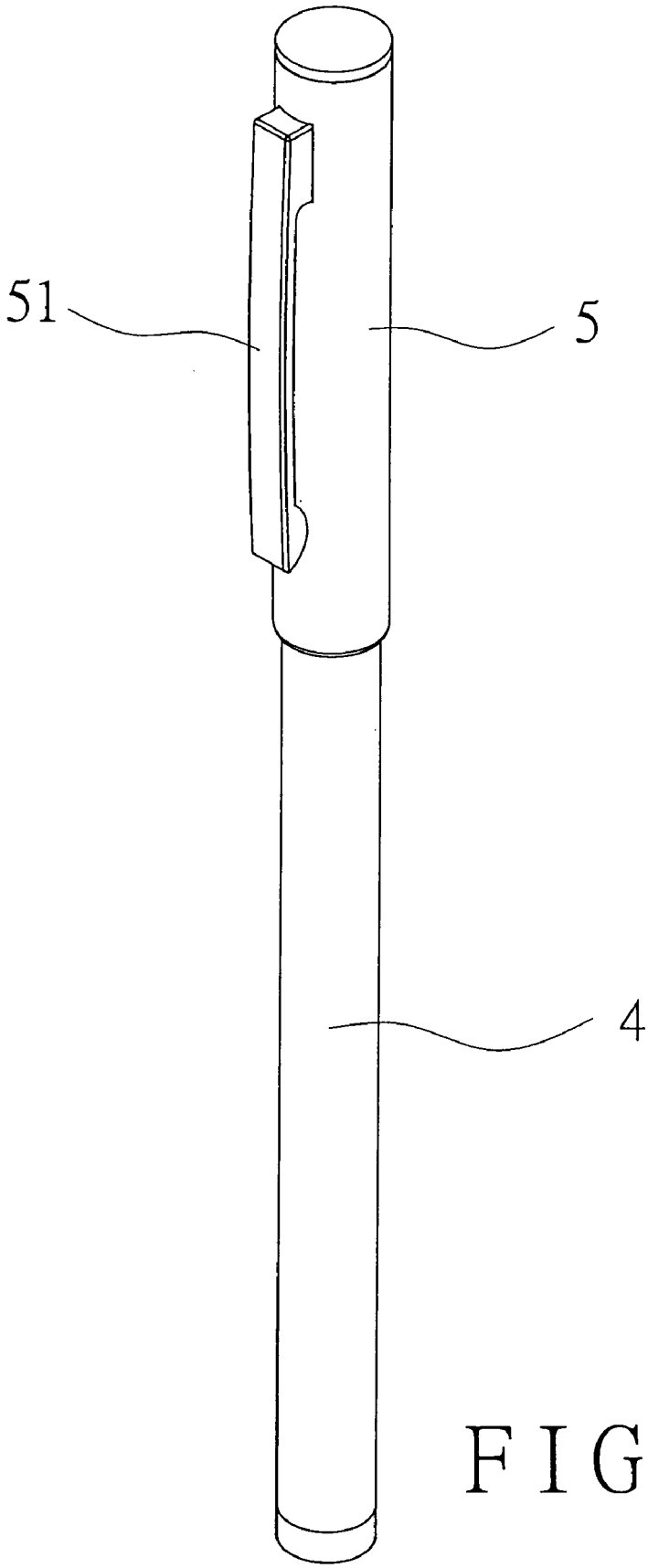
FIG. 5 is a sectional view of the first embodiment with a cap.
Figure 6:
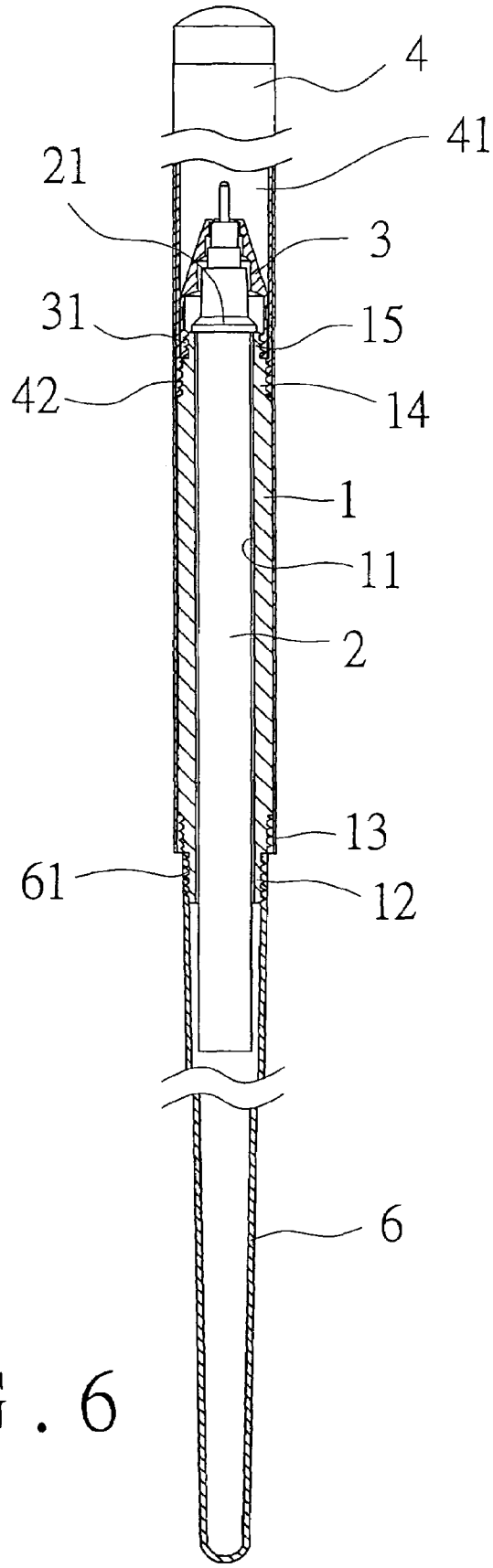
FIG. 6 is a sectional view, taken when the first embodiment is being adapted (3)
Figure 7:
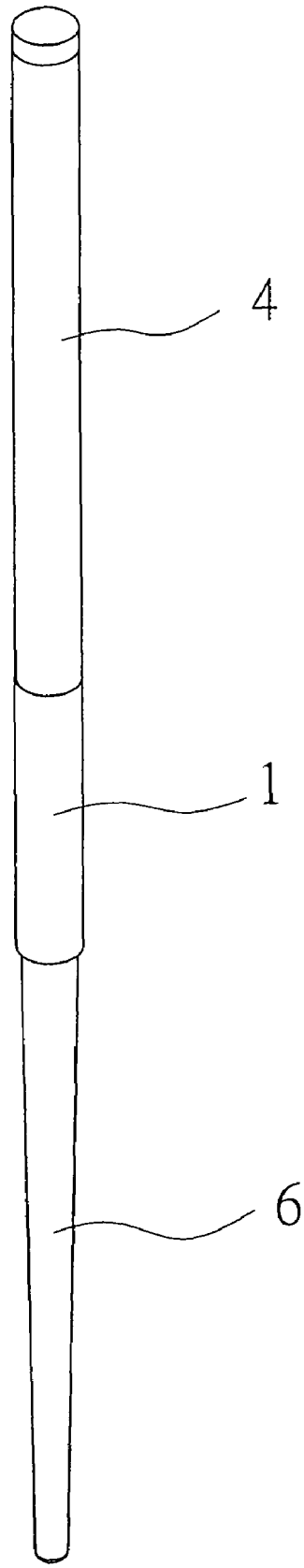
FIG. 7 is a view of the first embodiment being used as a chopstick, FIG. 8 an exploded perspective view of a second embodiment.
Figure 8:
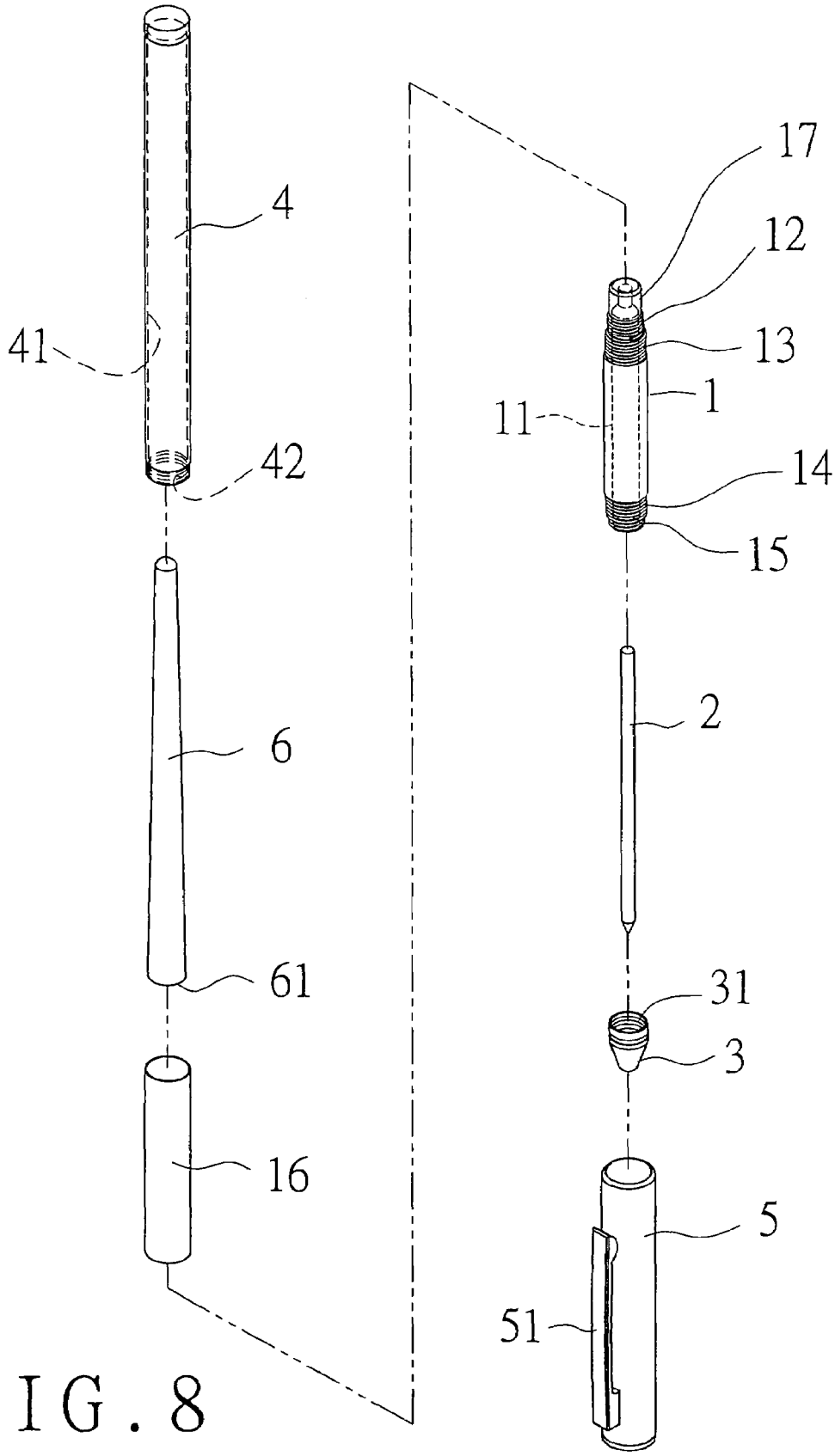

Referring to FIG. 1, in assembly, first the water ink-containing writing core 2 is positioned in the middle hollowness 11 of the writing implement tube 1 with the stopping rim 21 contacting an edge of the fourth threaded portion 15 of the writing implement tube 1. Next, the writing implement head sleeve 3 is positioned around the writing core 2, and threadedly joined on the fourth threaded portion 15 of the writing implement tube 1. And, the chopstick member 6 is threadedly joined on the first threaded portion 12 of the tube 1. Next, the writing implement shell 4 is positioned around the chopstick member 6, and threadedly joined on the second threaded portion 13 of the tube 1; thus, the present invention can be used as a writing implement, as shown in FIGS. 3 and 4. If the user doesn't need to use the writing implement, he/she can position the cap 5 around the middle circumferential portion 16 of the writing implement tube 1; thus, the present writing implement and chopstick combination can be fastened to an object by means of the fastening piece 51. If the user wants to adapt the present combination into a chopstick, he should separate the writing implement shell 4 from the second threaded portion 13 of the tube 1 so as to uncover the chopstick member 6, and join the shell 4 on the third threaded portion 14; thus, the chopstick member 6 can be used together with another one to serve as a pair of chopsticks, as shown in FIGS. 6 and 7.

Figure 10:
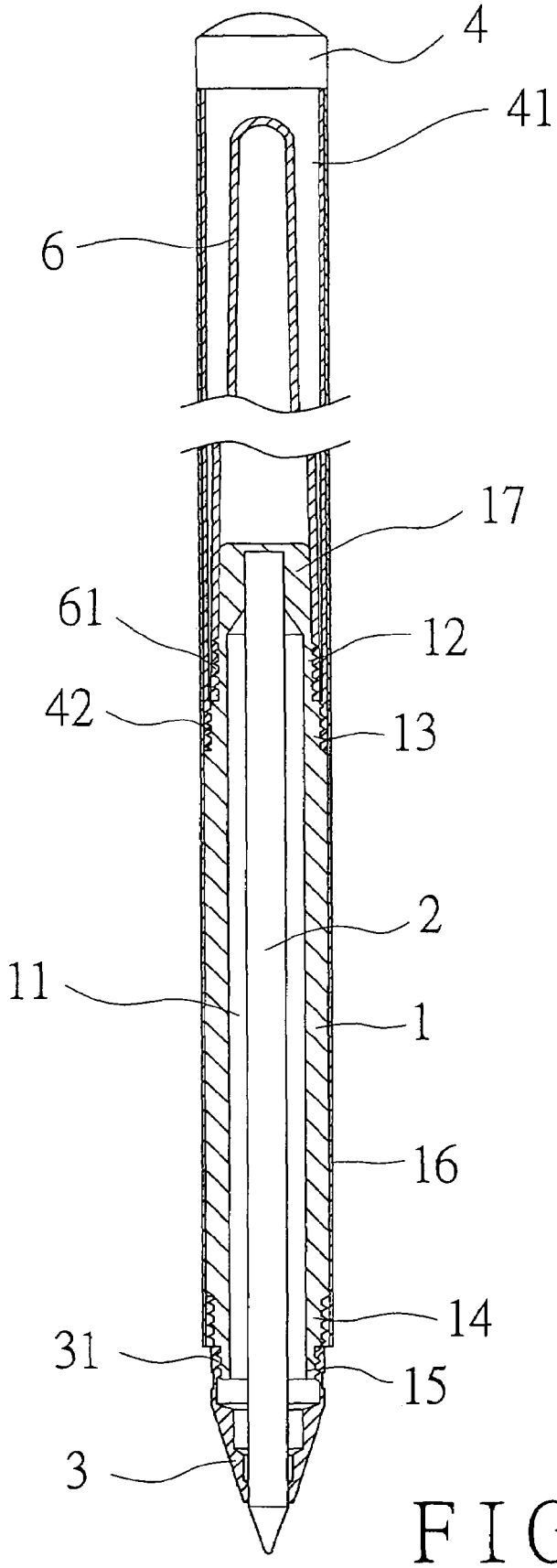
FIG. 10 is a sectional view, taken when the second embodiment is being adapted (2)
Figure 11:
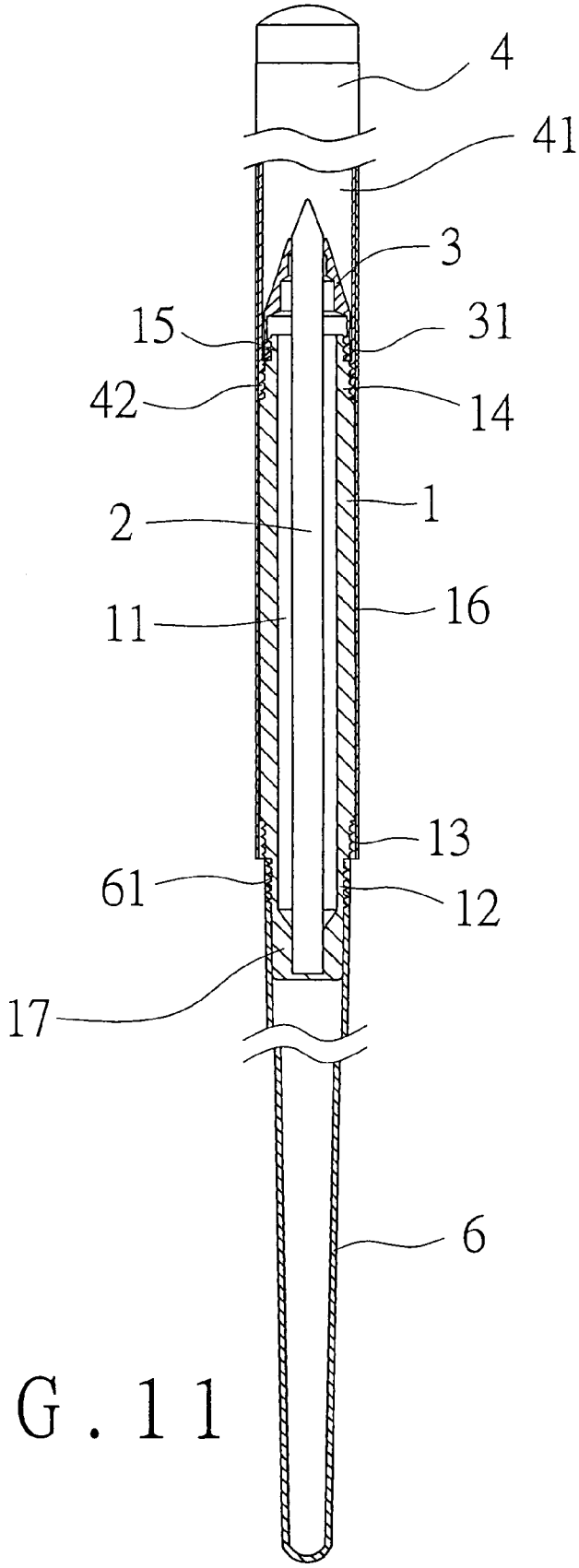
FIG. 11 is a sectional view, taken when the second embodiment is being adapted (3)

Shown in FIGS. 8 to 11 is a second preferred embodiment of a writing implement and chopstick combination of the invention; the second embodiment is basically the same as the first one, yet it includes a ball-point pen 2 for use as a writing core, and a writing implement tube 1, which has a closed position-limiting sleeve 17 protruding from a first threaded portion 12 thereof. In assembly, the ball-point pen 2 is passed through the writing implement tube 1 with a hindmost end thereof being received in and contacting the closed position-limiting sleeve 17, and the writing implement head sleeve 3 is positioned around a front end of ball-point pen 2, and joined on the fourth threaded portion 15, and the chopstick member 6 is threaded joined on the first threaded portion 12, and next the writing implement shell 4 is positioned around the chopstick member 6 and threaded joined on the second threaded portion 13; thus, the present combination becomes a ball-point pen, as shown in FIG. 10. If the user wants to adapt the present combination into a chopstick, he should separate the writing implement shell 4 from the second threaded portion 13 of the tube 1 so as to uncover the chopstick member 6, and join the shell 4 on the third threaded portion 14; thus, the chopstick member 6 can be used together with another one to serve as a pair of chopsticks, as shown in FIG. 11.

Figure 12:
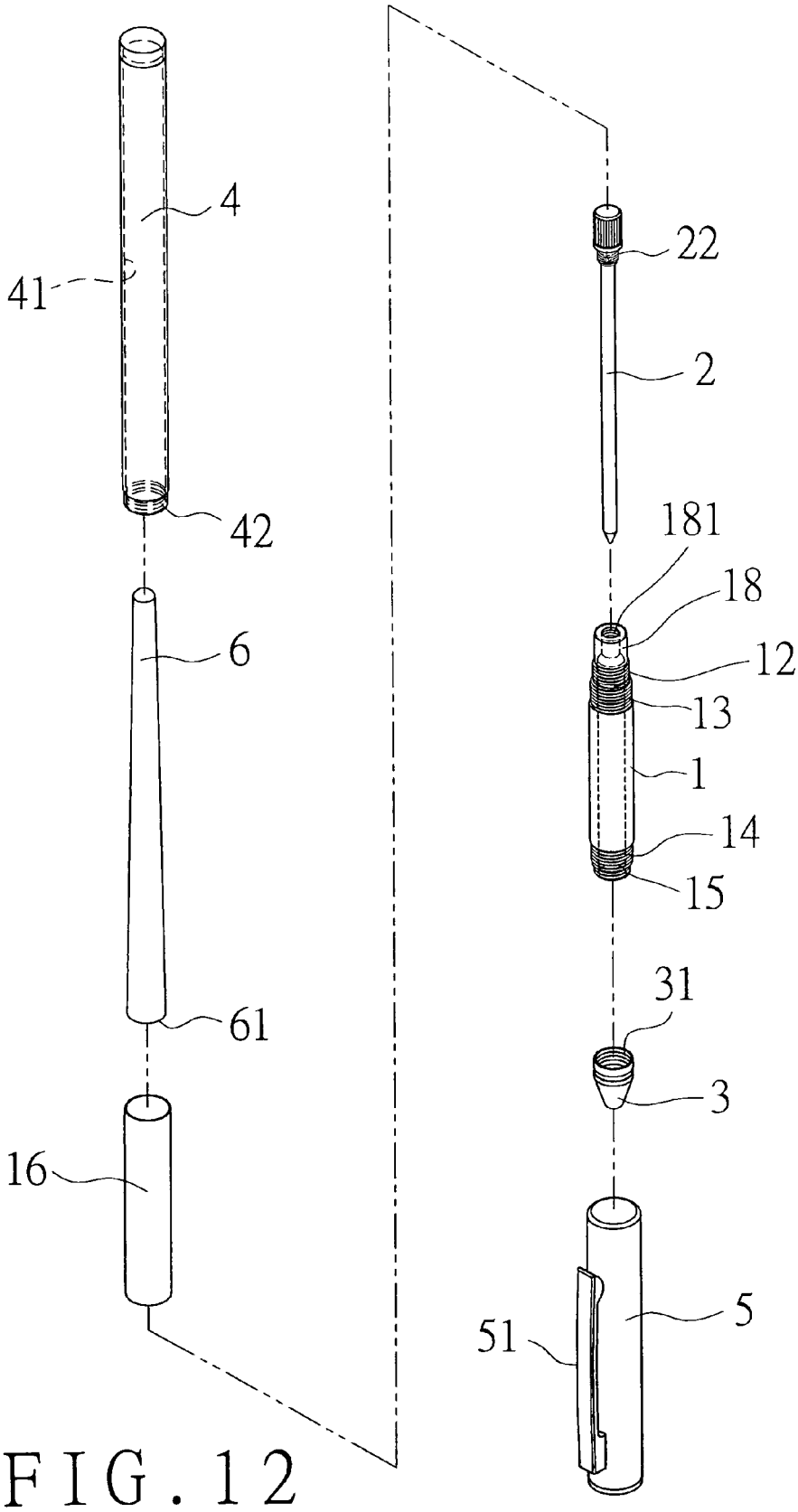
FIG. 12 is an exploded perspective view of the third preferred embodiment of the present invention.
Figure 13:
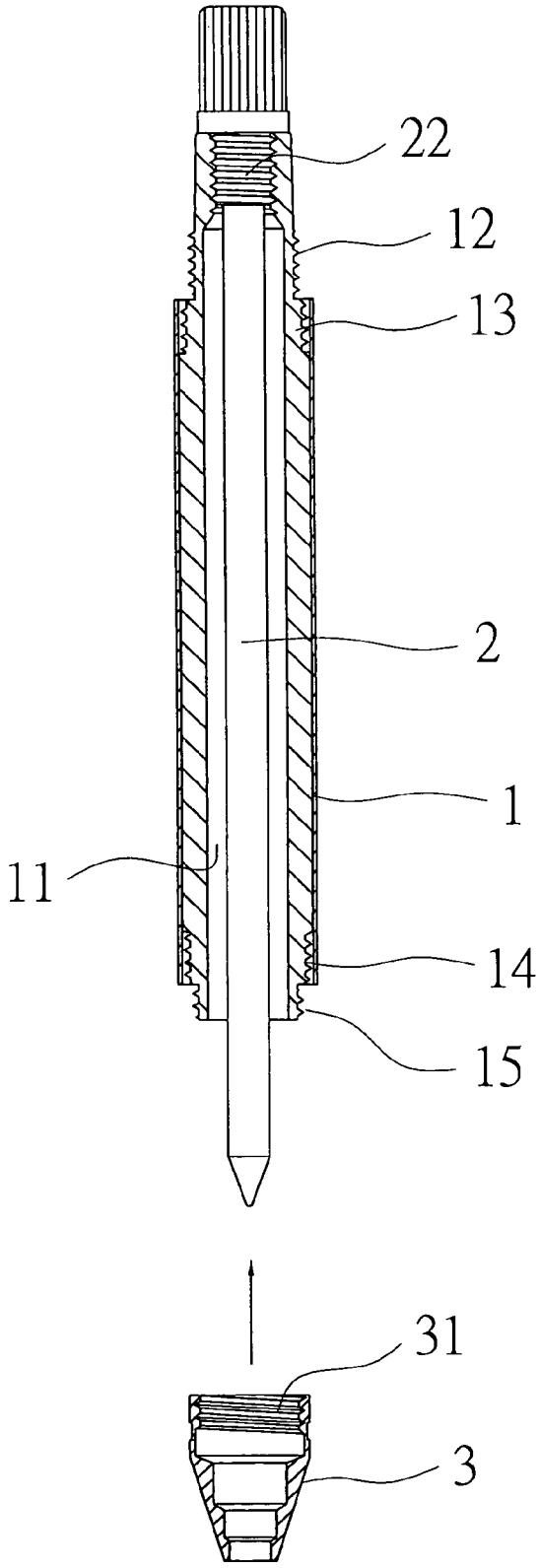
FIG. 13 is a sectional view of the third preferred embodiment.

Shown in FIGS. 12 and 13 is the third preferred embodiment of a writing implement and chopstick combination of the present invention, wherein the writing core 2 is a ball-point pen writing core with a threaded head portion 22, and the writing implement tube 1 further has a fixing portion 18, which extends from the first threaded portion 12, and which has several inner threads 181; in assembly, the head sleeve 3 is threadedly joined on the fourth threaded portion 15 of the writing implement tube 1, and the ball-point pen writing core 2 is passed through the writing implement tube 1 and the head sleeve 3, and joined to the threaded fixing portion 18 at the threaded head portion 22 thereof.

The writing core in accordance with the present invention can be one of an eyebrow pencil, a lead pencil, a marker with luminous ink, a lip brush or a lipstick besides the above-mentioned water ink-containing writing core and ball-point pen writing core. In other words, the writing cores of a wide variety of writing implements can be positioned in the writing implement tube 1 and joined to the chopstick member 6 for use.

From the above description, it can be seen that the present invention has the following advantages over the prior arts:

1. The writing implement tube has a closed position-limiting sleeve at the hindmost end, which is provided for use with a writing core of a ball-point pen, and can be cut off for the tube to be used with a water ink-containing writing core. Therefore, the manufacturer only has to have a kind of mold to manufacture writing implement tubes, and the products can be adapted for use with either a water ink-containing core or a ball-point pen core. In other words, it will help the manufacturer save cost to put the present invention into practice.

2. The present invention can be adapted for use as either a writing implement or a chopstick according to the user's need. Therefore, it is dual-functional and easily portable, providing much convenience.

3. The writing core in accordance with the present invention can be one of a water ink-containing writing implement, a ball-point pen, an eyebrow pencil, a pencil, a marker with luminous ink, a lip brush or a lipstick. In other words, the writing cores of a wide variety of writing implements can be used in the present writing implement and chopstick combination for the present invention to have a wide application.

What is claimed is:

1. A writing implement and chopstick combination, comprising a writing implement tube, which is hollow; the writing implement tube having first and second step-shaped ends; the first step-shaped end including first and second threaded portions; the second step-shaped end including third and fourth threaded portions; the writing implement tube having a middle circumferential portion, which sticks farther away from an axis of the writing implement tube than the second and the third threaded portions;

a writing core held in the writing implement tube;

a writing implement head sleeve, which is joined on the fourth threaded portion of the writing implement tube with the writing core sticking out therefrom; the writing implement head sleeve having a threaded portion on an inner side thereof to threadedly engage the fourth threaded portion of the writing implement tube;

a writing implement shell with a hollow holding room, the writing implement shell having a threaded portion on an inner side of an open end thereof to threadedly engage one of the second and the third threaded portions of the writing implement tube; the writing implement shell being capable of being repositioned relative to the writing implement tube;

a cap to be positioned around the middle circumferential portion of the writing implement tube; and a chopstick member joined on the first end of the writing implement tube, the chopstick member having a threaded portion on an inner side of one end thereof, which threadedly engages the first threaded portion of the writing implement tube.

2. The writing implement and chopstick combination as claimed in claim 1, wherein the writing core is a water ink-containing writing core.

3. The writing implement and chopstick combination as claimed in claim 2, wherein the water ink-containing writing core has a stopping rim on a front end thereof, which contacts an edge of the fourth threaded portion of the writing implement tube.

4. The writing implement and chopstick combination as claimed in claim 1, wherein the writing core is a ball-point pen writing core.

5. The writing implement and chopstick combination as claimed in claim 4, wherein the writing implement tube has a closed position-limiting sleeve protruding from the first threaded portion thereof, and a tail end of the ball-point pen writing core is received in and contacts the closed position-limiting sleeve.

6. The writing implement and chopstick combination as claimed in claim 1, wherein the writing core is a ball-point pen writing core with a threaded head portion.

7. The writing implement and chopstick combination as claimed in claim 6, wherein the writing implement tube has a fixing portion, which extends from the first threaded portion, and which has plural inner threads to adjoin the threaded head portion of the ball-point pen writing core.

8. The writing implement and chopstick combination as claimed in claim 1, wherein the cap has a fastening piece thereon.

9. The writing implement and chopstick combination as claimed in claim 1, wherein the writing core is a lead pencil writing core.

10. The writing implement and chopstick combination as claimed in claim 1, wherein the writing core is a marker with luminous ink.

11. The writing implement and chopstick combination as claimed in claim 1, wherein the writing core is an eyebrow pencil.

12. The writing implement and chopstick combination as claimed in claim 1, wherein the writing core is a lipstick.

* * * * *